US005502894A

United States Patent [19]

Burke et al.

[11] Patent Number: 5,502,894

[45] Date of Patent: Apr. 2, 1996

[54] METHOD OF CONSTRUCTING A CERAMIC OXY-GAS TORCH TIP

[76] Inventors: Thomas M. Burke, deceased, late of Los Gatos, Calif. 95030; Bernadette M. Burke, administrator, 259 More Ave., Los Gatos, Calif. 95030; Dale L. Dickeson, 2873 LaJolla Ave., San Jose, Calif. 95124

[21] Appl. No.: 462,208

[22] Filed: Jun. 5, 1995

Related U.S. Application Data

[63] Continuation-in-part of Ser. No. 234,844, Apr. 28, 1994, abandoned.

[51] Int. Cl.[6] ..... B23P 21/00

[52] U.S. Cl. ..... 29/890.02; 239/423

[58] Field of Search ..... 29/890.02, 890.14, 29/890.142, 890.143, 469; 239/418, 423, DIG. 19

[56] References Cited

U.S. PATENT DOCUMENTS

| | | | |
|---|---|---|---|
| 2,343,958 | 3/1944 | Crowe . | |
| 2,671,501 | 3/1954 | Marra . | |
| 2,911,035 | 11/1959 | Nieman et al. | 239/423 |
| 3,204,682 | 9/1965 | Teleshefsky et al. . | |
| 3,558,062 | 1/1971 | See . | |
| 3,643,871 | 2/1972 | Hamernik et al. . | |
| 3,838,820 | 10/1974 | Pearce . | |
| 3,856,457 | 12/1974 | Miller . | |
| 3,876,149 | 4/1975 | Futerko . | |
| 4,813,093 | 3/1989 | Levin | 29/890.02 |

OTHER PUBLICATIONS

Carlisle Gas Burner Corp., Bulletin 212, No. 104–373 MOD.

Carlisle Gas Burner Corp., Bulletin 211, HV–900 Burner.

*Primary Examiner*—David P. Bryant

*Attorney, Agent, or Firm*—Carothers & Carothers

[57] ABSTRACT

The design and practical method of providing an all ceramic externally mixing dual gas torch with a multiplicity of intimately adjacent emissions supplied from separate and isolated internal gas chambers. Four-bore ceramic tubing is used and two of the through bores access the isolated fuel gas chamber and side-slotting or notching accesses the remaining two holes to the isolated oxygen chamber. The bundling of a multiplicity of slotted tubings provides a multiplicity of intimately adjacent dual gas emissions. The slots are oriented to provide a desired flame pattern.

11 Claims, 2 Drawing Sheets

METHOD OF CONSTRUCTING A CERAMIC OXY-GAS TORCH TIP

This application is a continuation-in-part of U.S. patent application Ser. No. 08/234,844, filed Apr. 28, 1994, now abandoned.

BACKGROUND OF THE INVENTION

This invention pertains to torches and more particularly to a torch designed to provide a clean burning flame for the quartz and glass blowing industry. More specifically, the torch of the present invention is designed to provide a torch tip constructed entirely from ceramic that does not emit oxidized particles during operation.

BACKGROUND—DESCRIPTION OF PRIOR ART

Torch prior art dictates that hydrogen and oxygen burn so rapidly that the gasses cannot be pre-mixed inside the torch. Rapid burning causes flash-back of the flame to the internal point of mixing. Separate and isolated hydrogen and oxygen emissions must be provided for external mixing to prevent flash-back.

Prior art also provides that, to maintain a smooth and even burn, a multiplicity of very small gas emmissions works much better than just a few large emissions for external mixing torches. These small emissions must be intimately adjacent to each other for proper mixing at exit. Most of the marketed oxy-hydrogen torches meet the foregoing prior art criteria. However, they are all made from metal and they all suffer similar disadvantages.

When exposed to raw oxygen, metal torches oxidize during normal operation. The metal oxide flakes off and is emitted onto the quartz or glass being heated. Devitrification occurs causing the quartz or glass to become undesirably opaque. Production is interrupted to rid the torch of oxide build-up. The work cools down causing further delay during reheating. In fact, this invention was inspired by complaints from a disgruntled plant operator, who emphasized the need for a clean burning torch.

At least one manufacturer of metal torches cautions that, reduced or normalized fires in the low flow range, will cause premature burn out of the tubes; and when used on a low soft flame, oxidizing effects should be maintained.

The erosion caused by oxidation shortens the life of metal torches, and costly replacement is frequent.

In many operations, metal torches will self-destruct in the high ambient demanded of them. Heat exchangers and other expensive and cumbersome cooling methods are needed to alleviate this condition. Even then maximum heating capability is limited by the effectiveness of cooling. Limited heating capacity is not conducive to speedy production in the quartz and glass blowing industry.

OBJECTS AND ADVANTAGES OF THE INVENTION

The torch of the present invention fulfills the following objects and advantages:

(a) to provide a practicable all ceramic torch that meets the foregoing prior art criteria. ie., external gas mix and multiplicity of emissions;

(b) to provide a clean burning torch that does not oxidize and emit oxidized particles onto the material being heated;

(c) to provide a torch that will not suffer premature burn out while producing a low soft flame;

(d) to provide a torch whose life is not shortened by erosion caused from oxidation, requiring frequent and costly replacement;

(e) to provide a torch that will withstand the highest ambients demanded by many operations, without adding expensive and cumbersome heat exchangers or other cooling methods; and (f) to provide a torch that will speed up production and produce a cleaner product.

Other objects and advantages appear hereinafter in the description and claims.

SUMMARY OF THE INVENTION

The ceramic dual-gas externally mixing torch tip of the present invention is comprised of a multiplicity of intimately adjacent gas emission bores which are provided in a ceramic body. This ceramic body is sealed in a ceramic housing having two isolated gas chambers with respective gas supply ports for supplying separate gases under pressure respectively to these chambers. The ceramic body is housed within this ceramic housing such that the bores of the ceramic body exit to ambient for external mixing of gases issuing from the adjacent gas emission bores. Selected ones of these bores are connected exclusively to one of the gas chambers and selected others of the bores are connected exclusively to the other gas chamber within the housing.

The ceramic body providing these intimately adjacent gas emission bores for external mixing of the gases, consists of a multiplicity of clustered ceramic tubes with through bores and interstices formed between clustered tubes which provide these gas emission bores. Such ceramic tubing may be single bore ceramic tubing or is more preferably four-bore tubing which is commonly used for making thermocouples and is an off the shelf readily available item.

The ceramic tubes are clustered together and interstices thus formed between the clustered tubes are all or selectively sealed off at the upper ends of the tubes to provide the remaining multiplicity of intimately adjacent gas emission bores which are exposed to ambient for external mixing of the gases. Thus selected interstices between the upper ends of the clustered tubes, as well as selected tube bores, are utilized as gas emission bores exposed to ambient. None, all or some of the interstices between tubes may be utilized as gas emission bores.

Selected ones of these tube bores and/or tube cluster interstices are exposed exclusively to one of the gas chambers and selected others of the tube bores and/or tube cluster interstices are exposed exclusively to the other of the gas chambers within the ceramic housing.

Some of these clustered tubes may be shorter than others such that their bottom ends are exposed between the interstices of the clustered tubes to the one gas chamber and then the bores of the remaining longer tubes are exclusively exposed at their bottom ends to the other gas chamber within the ceramic housing. The interstices formed or created between the lower ends of the tubes are sealed off to isolate the respective gas chambers within the ceramic housing. Selected of the interstices between the upper ends of the tubes may be left open and used as gas emission bores along with the upper short tube bores.

In an alternative preferred method of construction, the sides of selected of these tubes are slotted or notched to thereby expose a predetermined number of these tube bores thereby providing upper and lower tube bore portions. The lower tube bore portions are then sealed or plugged off so that the notches and the upper tube portions are exposed exclusively to one of the gas chambers via the interstices created between the tube cluster and the path provided by adjacent slot arrangement. The exposed lower tube bore portions being plugged off totally isolates this one gas chamber from the other gas chamber within the torch tip housing.

When multiple bore tubes are provided for use in constructing the torch tip, the multiple bore tubes, such as common four-bore tubing, are tubes of substantially equal length and the sides of these tubes may be slotted or notched thereby exposing only a predetermined number of the multiple bores within each tube, for example exposing only two of the four tube bores, thereby providing upper and lower tube bore portions. The lower tube bore portions are plugged in order to isolate the one gas chamber from the other gas chamber within the torch tip housing. In similar fashion, the bottom ends of all the clustered tubes are also sealed therebetween in the interstices formed within the cluster to further insure isolation between the two gas chambers of the torch tip housing. The interstices formed between the upper ends of the tubes may be left open, selectively sealed off or all sealed off as desired.

The positioning and orientation of these notches is preselected in order to provide a desired torch flame burn pattern, and to provide a gas path to the outer periphery of the bundle.

In addition, a gas dispersion plate or element may also be provided in the other or bottom of the two isolated gas chambers for dispersing gas supplied thereto to provide homogeneous chamber pressure.

BRIEF DESCRIPTION OF THE DRAWINGS

Referring now to the drawings a total of 4 figures are shown.

DETAILED DESCRIPTION OF THE PREFERRED EMBODIMENT

Figure 1:
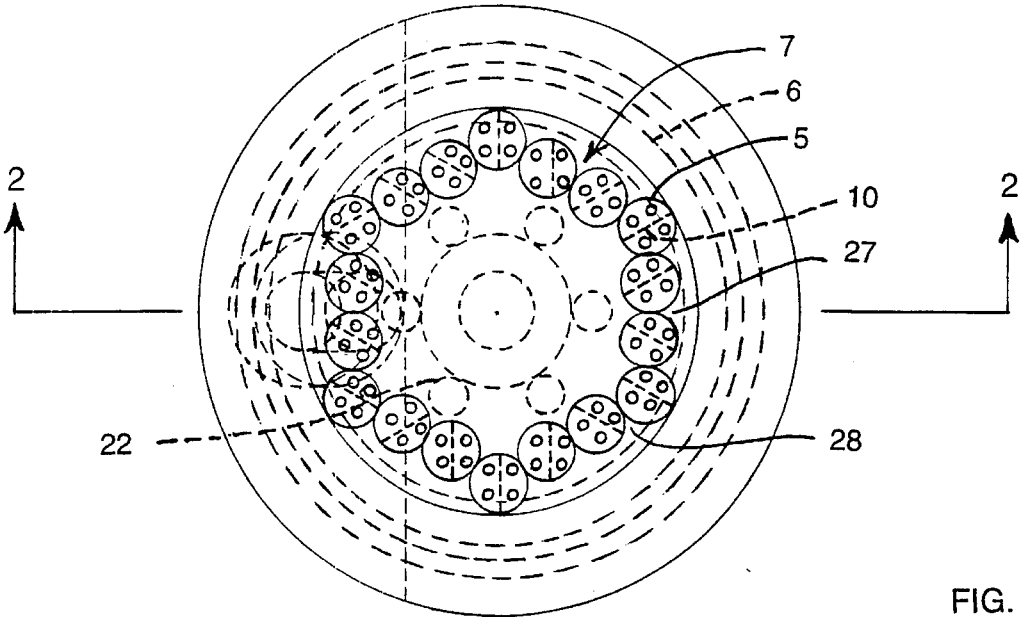
FIG. 1 is the top view and burning end of the torch tip of the present invention. For clarity, only 18 of the 37 pieces of the tubular part 5 are shown.

A preferred size, shape and burn pattern is depicted in the following description, but this does not preclude making other sizes, shapes and burn patterns using the same design principals. Hydrogen and oxygen are the two gasses mentioned, but other gasses may be substituted if applicable.

The basic torch tip of the present invention, not including gas inlet tubes, is 2" diameter by 2⅝" high. All parts are made from high strength non-porous ceramic. All parts are cylindrical or tubular in shape, and are easily formed by machine tooling.

In every case where ceramic adherent or filler is used, the same ingredients and curing process prevails. A slurry mixture of powdered ceramic and liquid hydrocarbons is made up to a consistency suitable to the application. Subsequent curing in a subsequent assembly will not effect a previously cured part. All ceramic used in the slurry mixture and individual parts is 99% pure alumina ($AL_2O_3$).

Hydrogen is supplied from the bottom of the torch and enters into an isolated hydrogen chamber. It then passes through 74 small emission holes to the top burning end of the torch.

Oxygen is separately supplied from the bottom of the torch and enters into an isolated oxygen chamber. It then passes through its own 74 small emission holes to the top burning end of the torch. The supply of oxygen and hydrogen to the respective chambers may be reversed.

Each hydrogen emission is intimately adjacent to a corresponding oxygen emission, and they mix immediately for ignition as they exit the torch. There is no contact of the two gasses inside the torch.

The prime novelty of this invention is the method of construction, and more specifically, the practicability of constructing a torch of this nature from all ceramic parts. A unique element is the use of "four-bore tubing" commonly used for making thermocouples. It is catalogued and sold off the shelf in a variety of sizes. The specific size used here is cut from a standard 12" length, which is 3/16" diameter solid ceramic with four uniformly spaced 1/32" diameter parallel holes through its length. The novel use of this "four-bore tubing" eliminates impractical drilling of a multiplicity of deep and tiny parallel holes into hard ceramic, in close proximity of one another. However, single bore tubing may also be used.

Further novelty is the side slotting or notching exhibited wherein the first 2 through holes access the isolated fuel gas, and side slotting accesses the other 2 holes to an isolated oxygen supply. The use of "four-bore tubing" in this specific design, does not preclude the similar use of single-bore or other multi-bore tubing, ie. two-bore, three-bore, etc., for other torch sizes, shapes and burn patterns.

Before assembly, we will describe in detail the construction of tubular part 5 and subassembly 7. These are the key items for providing the multiplicity of separate and isolated gas emissions.

Figure 3:
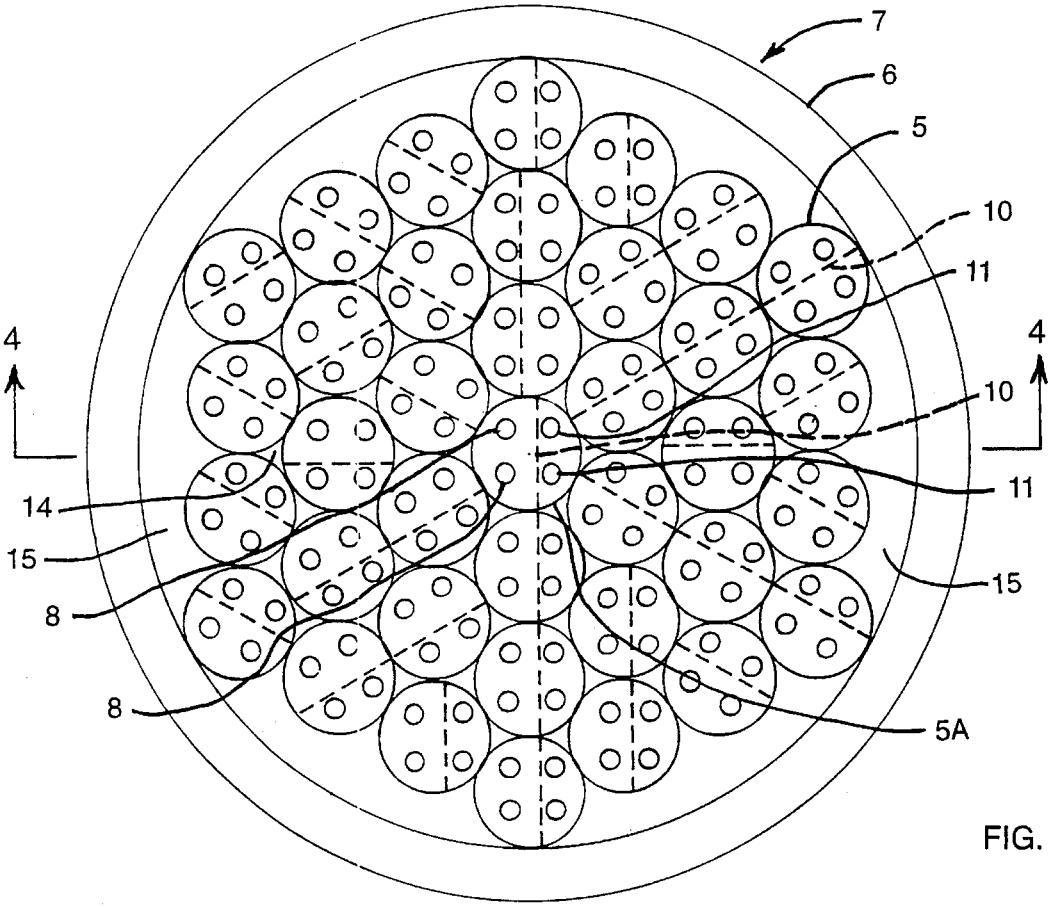
FIG. 3 is an enlarged top view of a sub-assembly 7 of the torch tip shown in FIG. 1, which is assembled from 37 pieces of the tubular part 5 and base ring 6.
Figure 4:
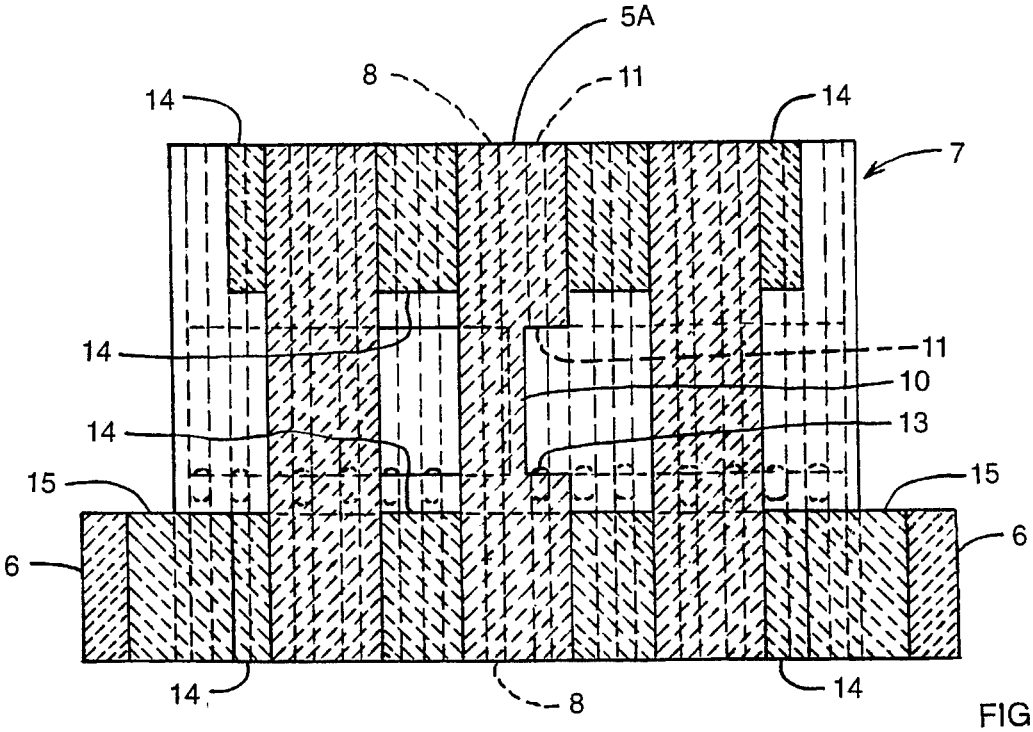
FIG. 4 is a cross-sectional view of FIG. 3 taken along line 4—4.

Referring to FIG. 3 and FIG. 4, one piece of tubular part 5 has been singled out and designated as part 5A for describing all thirty-seven pieces of part 5.

Part 5A is made from a ⅞" length of 3/16" diameter "four-bore ceramic tubing". The two 1/32" diameter bores on the left penetrate all the way through, and are designated as hydrogen bores or passages 8. In final assembly shown in FIG. 2, passage 8 connects the burning end of the torch with the isolated hydrogen chamber 9.

Part 5A has a ¼" high oxygen slot or notch 10 cut into its side, just deep enough to totally expose its two remaining 1/32" diameter bores on the right. They are designated as oxygen passages or bores 11. In the final assembly shown in FIG. 2, passages 11 connect the burning end of the torch with the isolated oxygen chamber 12, via the oxygen slot or notch 10. The two bores (lower tube bore portions) exposed at the bottom surface of the oxygen slot 10 are sealed off with ceramic filler 13.

Having established 2 hydrogen emissions and 2 oxygen emissions, we proceed to subassembly 7 to multiply them.

Referring again to FIG. 3, subassembly 7 is constructed by bundling thirty-seven pieces of ceramic tubular part 5 and adding the ceramic base ring 6. The oxygen notch 10 of each part 5 is shown in dashed outline in FIGS. 1 and 3, and each part 5 is rotated to position or orient the thirty-seven oxygen slots 10 as shown. Noting in FIG. 2, that the outer contour of subassembly 7 is surrounded and engulfed by the oxygen chamber 12, this arrangement allows a preferred exposure to the oxygen supply producing a preferred burn pattern. Different burn patterns, satisfying other applications, may be provided by a different arrangement of oxygen slots 10. Prior to bundling of ceramic tubular parts 5, ceramic adherent is applied to each part 5 where they tangentially abut each other, and where they contact base ring 6. Subassembly 7 is now complete except for filling a multiplicity of void spaces with ceramic filler between the bottom ends of tubular parts 5 to seal off hydrogen chamber 9 from oxygen chamber 12 and between selected of the top ends to seal off oxygen chamber 12 from the exterior, except through passages 11 and selected unsealed interstices between the upper ends of tubular parts 5.

FIG. 3 and FIG. 4 show the triangular voids or interstices created when three pieces of part 5 abut each other. All, none or selected of these interstices at the top, and all of them at the bottom of the bundle are then filled to ¼" depth with ceramic filler 14. Care is taken so that excess filler does not enter into and obstruct the oxygen notches 10. Also, the void spaces or interstices between the outer contour of the bundle and the inner peripheral surface of the base ring 6, are filled with ceramic filler 15 flush with the top and bottom of base ring 6.

Subassembly 7 now is then oven cured, and all parts, adherents, and fillers, unite into one solid structure. After appropriate leak testing, we are ready for final assembly of the torch.

Figure 2:
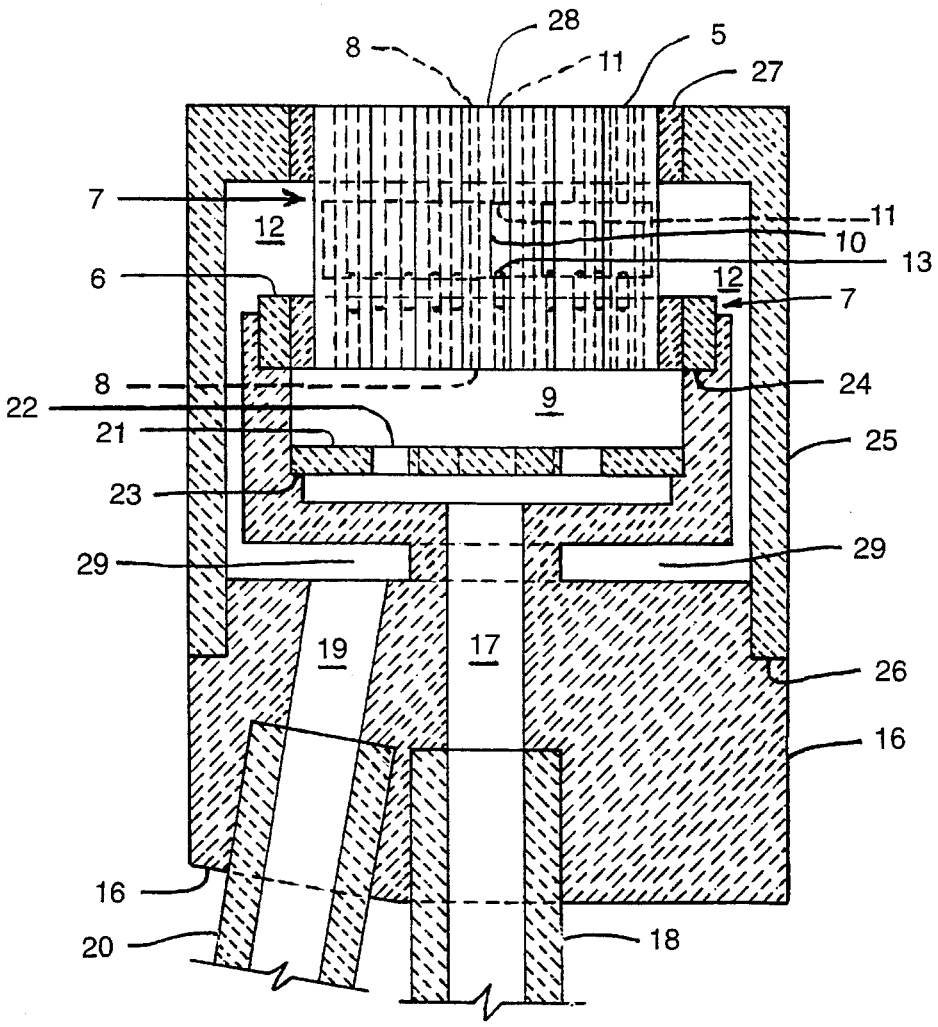
FIG. 2 is a cross-sectional view of FIG. 1 taken along line 2—2.

Referring now to FIG. 2, we proceed with final assembly of the torch. All parts fit together without need for alignment, and adequate clearance is allowed for adherents. The torch bottom or base 16 is machined from solid ceramic and shaped to receive all remaining parts.

The hydrogen inlet hole 17, is counter-bored to receive the inlet tube 18 using ceramic adherent on all contacting surfaces.

The oxygen inlet hole 19 is counter-bored to receive the inlet tube 20 using ceramic adherent on all contacting surfaces. The bottom surface of base 16 is chamfered to separate the inlet tubes for hose clamping room.

The ceramic baffle plate 21, which is ⅛" thick and has six off center ⅛" diameter hydrogen dispersement bores 22, is seated onto its counter-bored ledge 23 in base 16 using ceramic adherent on all contacting surfaces.

Subassembly 7 is seated onto its counter-bored ledge 24 in base 16 using ceramic adherent on all contacting surfaces. The void space immediately under subassembly 7, now creates the isolated hydrogen chamber 9.

The outer ceramic cover 25, which has ⅛" thick side walls, is fitted over subassembly 7 and seated onto the outer grooved ledge 26 provided in base 16 using ceramic adherent on all contacting surfaces. The void space inside the torch, created by clearance between the inner peripheral wall of cover 25 and remaining interior parts, now serves as the isolated oxygen chamber 12.

Viewing the top of the torch in FIG. 1, the void spaces between the inner peripheral surface of cover 25 and the outer contour of subassembly 7, are filled with ceramic filler 27 flush with the top of the torch and ¼" deep.

The completed assembly then goes through a final oven curing process and emerges with all parts, adherents, and fillers united into a solid ceramic torch ready for use.

OPERATION OF THE INVENTION

Operation is best described by viewing FIG. 2.

Hydrogen enters via passage 17. It is disbursed before entering the hydrogen chamber 9 by having to first pass through the six smaller bores 22 in baffle plate 21. This dispersion prevents in-rush and provides a homogenous supply of hydrogen within the hydrogen chamber 9. The inclusion of baffle plate 21 is not mandatory. It now passes through the seventy-four hydrogen bores 8, provided at the bottom of subassembly 7, to the top burning end 28 of the torch.

Oxygen enters via passage 19. The machined relief space 29 provided in base 16 allows it to flow into the isolated oxygen chamber 12. No baffling is required because limited in-rush and adequate dispersement is provided by the inner structure and overall peripheral expanse of the oxygen chamber 12. Oxygen now flows into each of the thirty-seven oxygen notches 10, and through each of the seventy-four bores 11 and interstices between the clustered tubes which remain unplugged or open in subassembly 7, to the top burning end 28 of the torch for externally mixing with the hydrogen.

Each of the seventy-four hydrogen emissions is intimately adjacent to each of the seventy-four plus oxygen emissions as they merge externally for ignition. Again, the ease of fabricating this multiplicity of intimately adjacent emissions from ceramic, comes from the novel use of four-bore thermocouple ceramic tubing, which is a readily available off the shelf item.

Accordingly the reader will see that we have provided a practical method and design for making an all ceramic, externally mixed, dual gas torch, having a multiplicity of intimately adjacent dual gas emissions supplied from separate and isolated chambers.

The practicality is in the novel use of four-bore thermocouple tubing wherein two of its through holes access the isolated hydrogen chamber, and side slotting accesses the other two holes to the isolated oxygen chamber. The bundling of a multiplicity of side-slotted 4-bore tubings enables a multiplicity of isolated hydrogen accesses, and a multiplicity of intimately adjacent isolated oxygen accesses. Flame pattern is also controlled by preselected slot orientation.

Finally, prior art criteria of external mix and multiplicity of emissions, has been met with an all ceramic torch, having the many advantages not provided in existing metal torches.

The preferred design embodiment described herein has a multiplicity of hydrogen and oxygen emissions with the possibility of more oxygen emissions through tube cluster interstices. By controlling the pressure and flow of the two gases within the respective chambers 9 and 12, the flame intensity and even burn capabilities may also be regulated.

Also, in order to avoid minor cold spots or hot spots in the burn pattern of the torch tip, the two bores providing hydrogen and oxygen emissions need not necessarily be equal in number. By regulating the number of respective hydrogen and oxygen gas emission bores and arranging them to a desired configuration, one may also regulate the flame burn pattern. Similarly, one may eliminate the oxygen slots or notches 10 at a given location or add extra hydrogen tube bores in a desired arrangement to effect the burn pattern.

In addition, it must be realized that while the preferred embodiment described is depicted as being manufactured with common off the shelf four-bore ceramic tubing, singe bore ceramic tubing may also be utilized by the manufacturer of the torch tip of the present invention. Such single bore tubing may be notched or slotted with notches 10 in the same manner thereby selectively exposing the interior bore of the slotted tubes to the oxygen chamber 12 and the remaining tubes which are not notched or slotted are exposed exclusively to the hydrogen chamber 9. Of course the bottom bore portions of the slotted tubes are plugged to maintain isolation between oxygen chamber 12 and hydrogen chamber 9.

Additionally, instead of merely slotting or notching selected of the single bore ceramic tubes, selected of the single bore tubes may be cut short or be shorter in length than the longer single bore tubes which penetrate on downward into the hydrogen chamber 9. Accordingly the through bores in the shorter tubes are exposed exclusively to the oxygen chamber 12 of the torch housing via the interstices provided between the tube cluster of alternately adjacent longer single bore tubes.

In addition, the number of interstices left open to ambient atmosphere between tubes, and the number of these short oxygen supply tubes and their specific location or orientation in cluster subassembly 7 may be regulated to provide the appropriate flame burn pattern and heat intensity.

In this single bore tube configuration wherein the oxygen tubes are provided in a shorter length, the interstices provided between the bottom ends of the longer tubes providing the hydrogen emission gas bores are similarly sealed off to insure isolation between oxygen chamber 12 and hydrogen chamber 9.

Burn pattern may also be altered by revising size, quantity and location of gas disbursement bores 22 in baffle plate 21.

It is claimed:

1. A method of constructing a ceramic dual gas externally mixing torch tip comprising the steps of:

providing a multiplicity of ceramic tubes, each of said tubes including at least one through bore and having upper and lower ends;

clustering said tubes together and sealing off selected interstices created between the clustered tubes at the upper ends thereof, such that said tube bores and selected interstices provide a multiplicity of intimately adjacent gas emission bores; and housing said clustered tubes in a sealed ceramic housing having two isolated gas chambers with selected ones of said tube bores exposed exclusively to one of said gas chambers and selected others of said tube bores exposed exclusively to the other of said gas chambers and with the upper ends of said tubes exposed to atmosphere for external mixing of isolated pressurized gases supplied from each of the chambers.

2. The method of claim 1, further including the steps of:

notching the sides of selected of said tubes for exposing a predetermined number of said bores, thereby providing upper and lower tube bore portions in said selected tubes;

plugging said lower tube bore portions such that said notches, said upper tube bore portions, and any upper unsealed interstices between tubes are exposed exclusively to one of said isolated gas chambers through adjacent notches and mid-portion interstices created between said clustered tubes; and sealing off interstices created between the clustered tubes at the lower ends thereof for exposing the remaining bores of said tubes not exposed by said notches exclusively to the other of said chambers.

3. The method of claim 2 wherein said tubes are multiple bore tubes of substantially equal length and said notches expose a predetermined number of said multiple bores.

4. The method of claim 3 wherein said multiple bore tubes are four-bore tubes.

5. The method of claim 4 wherein said notches expose two of said four bores.

6. The method of claim 2, further including the step of positioning and orienting said notches in a preselected manner to provide a desired torch flame burn pattern.

7. The method of claim 2, further including the step of providing a gas dispersion element in said other of said chambers for dispersing pressurized gas supplied thereto to provide homogeneous chamber pressure.

8. A method for constructing a ceramic dual-gas externally mixing torch tip comprising the steps of:

providing a plurality of multiple bore ceramic tubes of substantially equal length and having upper and lower ends;

side notching selected of said tubes to expose a predetermined number of said bores at each notch, thereby providing upper and lower tube bore portions in said selected tubes;

plugging said lower tube bore portions;

clustering said tubes together with said notches oriented in a preselected manner, thereby creating interstices between said tubes, sealing off selected upper portions of said interstices at the upper ends of said tubes and all of the interstices at the lower ends of said tubes, leaving said notches, said selected upper portions of said interstices, and intermediate portions of said interstices open, such that said intermediate and selected upper portions of said interstices and said notches are intercommunicative;

housing said clustered tubes in a sealed ceramic housing with the upper end of said tube cluster exposed to atmosphere for external mixing of gases issuing therefrom;

providing said housing with a first isolated gas chamber exposed exclusively to said notches and said intermediate and selected upper portions of said interstices, and a second gas supply chamber exposed exclusively to the lower end of said tube cluster; and providing respective supply ports in said chambers for respectively supplying separate pressurized gases to said chambers.

9. The method of claim 8 wherein said tubes are four-bore tubes and the step of notching is accomplished by accessing two of said bores with each of said notches.

10. The method of claim 9 wherein said notches are positioned and oriented in a preselected manner to provide a desired torch burn pattern.

11. The method of claim 10, further including the step of providing a gas dispersion element in said second gas supply chamber for dispersing gas supplied thereto to provide homogeneous chamber pressure.

* * * * *